US006625941B2

(12) United States Patent
Shaw

(10) Patent No.: US 6,625,941 B2
(45) Date of Patent: Sep. 30, 2003

(54) DETACHABLE LINEAL FOR DOORS AND WINDOWS

(75) Inventor: Robert Shaw, Parma, MI (US)

(73) Assignee: CertainTeed Corporation, Valley Forge, PA (US)

( * ) Notice: Subject to any disclaimer, the term of this patent is extended or adjusted under 35 U.S.C. 154(b) by 0 days.

(21) Appl. No.: 09/783,501

(22) Filed: Feb. 14, 2001

(65) Prior Publication Data

US 2002/0108327 A1 Aug. 15, 2002

(51) Int. Cl.[7] ..... E04F 19/02

(52) U.S. Cl. ..... 52/211; 52/716.8; 52/717.05; 52/717.06; 52/718.04; 52/748.11

(58) Field of Search ..... 52/287.1, 288.1, 52/211, 212, 94, 716.8, 718.04, 718.05, 717.01, 717.03, 717.05, 717.06, 282.1, 748.11; 24/289, 292, 293, 294, 295, 297

(56) References Cited

U.S. PATENT DOCUMENTS

| | | | | | |
|---|---|---|---|---|---|
| 3,525,188 | A | * | 8/1970 | Torbett | 52/288.1 |
| 3,748,815 | A | * | 7/1973 | Parker | 52/714 X |
| D244,500 | S | | 5/1977 | Copeland | |
| 4,189,885 | A | | 2/1980 | Fritz | |
| 4,339,898 | A | * | 7/1982 | Pichette | 52/94 |
| D276,656 | S | | 12/1984 | Lindstrom | |
| 5,018,325 | A | * | 5/1991 | Geen et al. | 52/211 |
| D331,916 | S | | 12/1992 | DuBrucq | |
| 5,282,344 | A | | 2/1994 | Moore | |
| 5,392,579 | A | * | 2/1995 | Champagne | 52/520 |
| 5,444,954 | A | * | 8/1995 | Anderson | 52/288.1 |
| 5,519,969 | A | * | 5/1996 | Golba | 52/60 |
| 5,675,955 | A | * | 10/1997 | Champagne | 52/521 |
| 5,829,206 | A | | 11/1998 | Bachman | |
| 5,836,113 | A | * | 11/1998 | Bachman | 52/287.1 X |
| 5,941,033 | A | | 8/1999 | Adams | |
| 6,047,507 | A | | 4/2000 | Lappin et al. | |
| 6,067,691 | A | * | 5/2000 | Feltman | 24/295 |
| 6,115,982 | A | * | 9/2000 | Lindenberg | 52/287.1 X |
| 6,272,797 | B1 | * | 8/2001 | Finger | 52/94 |
| 6,408,589 | B1 | * | 6/2002 | Bousquet | 52/714 |

FOREIGN PATENT DOCUMENTS

| | | | | |
|---|---|---|---|---|
| FR | 2571557 | * | 4/1986 | 52/287.1 |
| GB | 2238070 | * | 5/1991 | 52/717.01 |
| WO | WO 83/01640 | * | 5/1983 | 52/211 |

* cited by examiner

*Primary Examiner*—Laura A. Callo
(74) *Attorney, Agent, or Firm*—Duane Morris LLP; Melanie S. Goddard

(57) ABSTRACT

A removable lineal and finishing system for framing doors or windows. The removable lineal includes a cover portion and a channel portion. The channel portion includes a latch portion for detachably mounting the lineal to a J-channel. The latch portion of the lineal is inserted between a hook portion of the J-channel and a siding material. A gap in the J-channel receives and secures siding materials. The J-channel is mounted to a wall of a building and abuts a frame for a door or window.

14 Claims, 3 Drawing Sheets

DETACHABLE LINEAL FOR DOORS AND WINDOWS

FIELD OF THE INVENTION

The present invention relates generally to building materials, and more specifically to materials for framing doors or windows.

DESCRIPTION OF THE RELATED ART

Siding of aluminum or vinyl is widely used for building exteriors due to its attractive appearance, durability and low maintenance costs. To provide a finished appearance, openings in a building exterior are often framed by J-channels or wide faced "lineals", which receive these siding materials and conceal the cut edges of such materials.

A common J-channel is disclosed in U.S. Pat. No. 4,189,885 to Fritz. A typical lineal is disclosed in U.S. Pat. No. 6,047,507 to Lappin et al. U.S. Pat. Nos. 4,189,885 and 6,047,507 are incorporated by reference herein in their entireties, for their teachings on J-channels and lineals.

U.S. Pat. No. 5,829,206 to Bachman discloses a snap-in trim for exterior siding having a top snap-in trim grasper for permanently interlocking with a hook at the end of a J-channel bracket. This article is used for assisting in finishing and securing a top panel for a wall to a J-channel of a soffit.

Typically, either a J-channel or a lineal, but not both, are used to frame windows or doors. J-channels are usually cheaper than lineals and thus are the preferred alternative when cost is a deciding criterion. Lineals, however, are often preferred over J-channels due to their more professional, finished and aesthetically pleasing appearance. Currently, a problem arises when a building owner wishes to upgrade from a J-channel to a lineal. Currently, the J-channel would need to be removed completely and replaced with a lineal, requiring the siding materials to be removed. Because the siding ends overlie the mounting flange of the J-channel, this involves removal of the overlying members. Such a process is expensive and labor-intensive.

An article is desired which would allow a J-channel to be upgraded to a lineal without the problem of having to remove the J-channel and siding materials.

SUMMARY OF THE INVENTION

The present invention is a removable lineal, a frame trim assembly which includes a removable lineal and a J-channel, a finishing system including a frame trim assembly, a wall of a building, a frame surrounding an opening in a wall of a building and a siding material, and a method for installing a frame trim assembly comprising a J-channel and a lineal. The lineal comprises a cover portion and a channel portion. The cover portion includes a front face and an inner edge. The inner edge connects the front face to the channel portion. The channel portion has a latch portion for interlocking with a J-channel.

DETAILED DESCRIPTION

Figure 1:
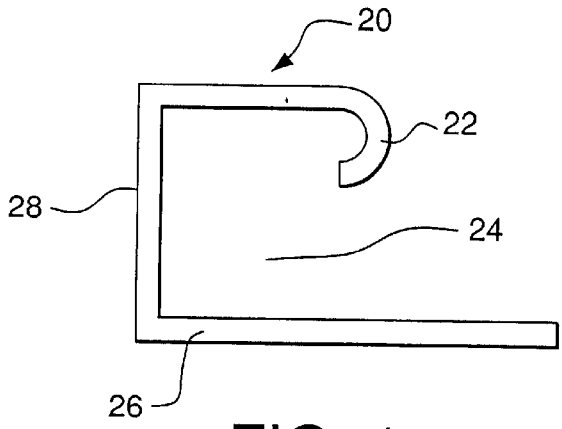
FIG. 1 (Prior Art)
FIG. 1 is an end view of a J-channel.
Figure 4:
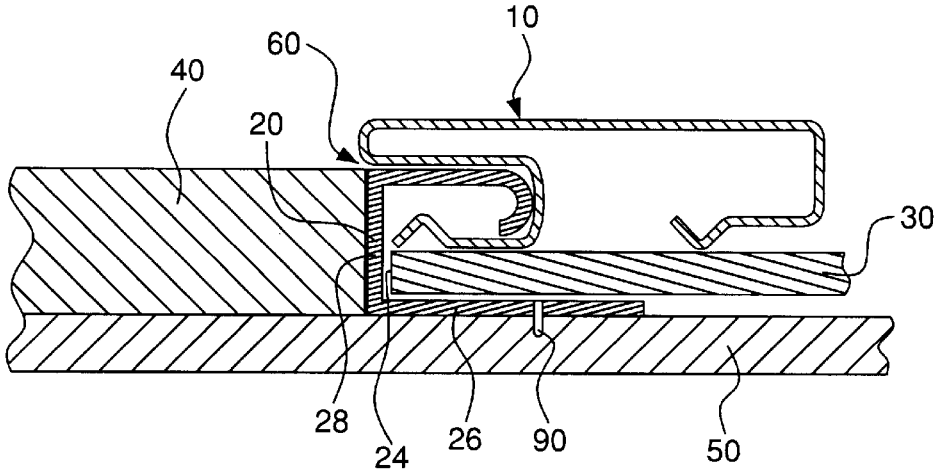
FIG. 4 is a sectional view of a finishing system.

FIG. 1 is a perspective view of a conventional J-channel. The J-channel 20 has a mounting flange 26, a hook portion 22, an inner edge 28 and a gap 24 between the hook portion 22 and the mounting flange 26. As shown in FIG. 4, the mounting flange 26 is mounted to the surface of a wall 50 and the inner edge 28 abuts against a frame 40 for an opening in a building such as for a door or window. The mounting flange 26 may contain a plurality of openings for receiving fasteners 90, such as nails or screws, for attaching the mounting flange 26 to the surface of a wall 50. The gap 24 between the mounting flange 26 and the hook portion 22 receives siding materials 30 such as vinyl or aluminum siding panels. The width of the gap 24 may vary according to the size and shape of the siding materials 30. The hook portion 22 overlaps the ends of the siding materials 30, concealing any variation in the length of the siding materials 30, which may be present after individual panels of the siding materials are cut by the installer.

Figure 2:
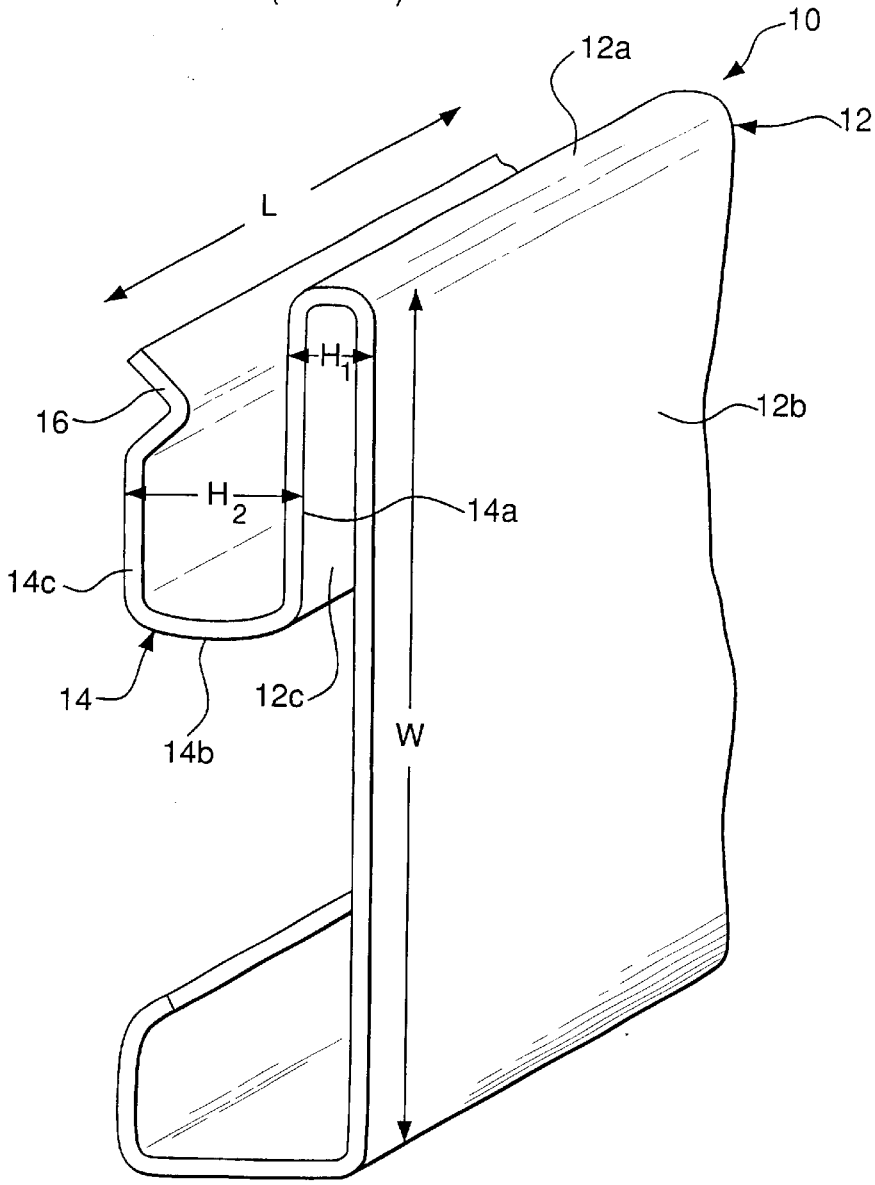
FIG. 2 is an isometric view of a lineal in accordance with the present invention.

FIG. 2 is an isometric view of an exemplary detachable lineal according to the present invention. The lineal 10 includes a cover portion 12 and a channel portion 14. The channel portion 14 comprises a proximal portion 14*a,* a distal portion 14*c* and a connecting portion 14*b*. The connection potion 14*b* connects the proximal portion 14*a* and the distal portion 14*c*. The distal portion 14*c* has a latch portion 16 at a terminal end. The latch portion 16 is a raised section of the distal portion 14*c* of the channel portion 14. The cover portion 12 preferably has an inner edge 12*a* and a front face 12*b*. The inner edge 12*a* connects the front face 12*b* of cover portion 12 to the proximal portion 14*a* of the channel portion 14. (Alternatively, the cover portion may not include an inner edge, but rather the front face may be attached directly to the channel portion.) A concavity 12*c* is formed behind inner edge 12*a,* that is, between front face 12*b,* inner edge 12*a* and proximal portion 14*a* of the channel portion 14.

Figure 3:
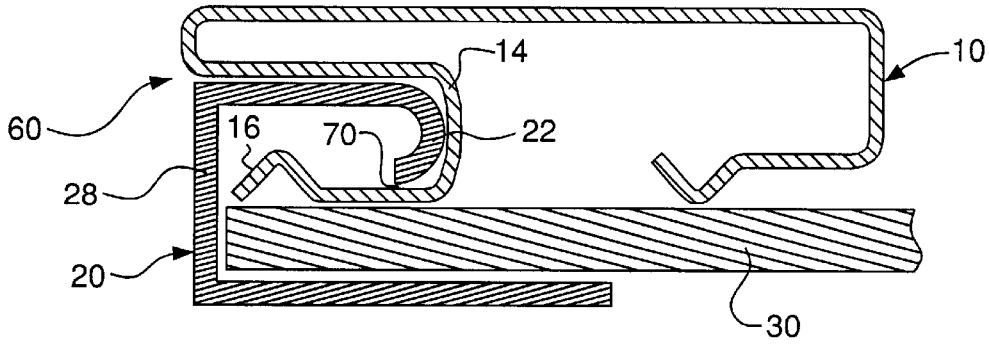
FIG. 3 is a sectional view of the frame trim assembly in conjunction with a siding material.

The raised latch portion 16 of the lineal 10 is insertable between the hook portion 22 of the J-channel 20 and a siding material 30 (See FIG. 3). Once inserted, the channel portion 14 of the lineal 10 receives the hook portion 22 of the J-channel 20. This insertion is carried out by pushing the latch portion 16 of the lineal 10 between the siding material 30 and the hook portion 22 of the J-channel 20. To accomplish this result, either the latch portion 16 or the hook portion 22 or both deform during the insertion until the latch portion 16 clears the hook portion 22. The latch portion 16 deforms by flattening when pushed against hook portion 22 of the J-channel 20. Alternatively, or in addition thereto, the hook portion 22 of the J-channel 20 is pressed inwardly when the latch portion 16 is pressed against it. Once the latch portion 16 has cleared the hook portion 22 those portions return to their normal shape and consequently, the lineal is secured within the J-channel.

The lineal as described herein may be formed from a single piece of a polymer such as a vinyl material. Other materials such as polypropylene, other polymers, or a polymer composite (such as polymer with reinforcing fibers of glass, graphite, wood, flax or other organic material), or metal, such as aluminum, or polymer coated metal, may also be used. The lineal may be molded, extruded or roll-formed from a flat sheet.

Preferably, the width (W) of the front face 12*b* of the lineal 10 is three and one-half inches or five inches (See FIG. 2). However, this width may be varied in accordance with the preference of the manufacturer. The height ($H_1$) of the inner edge 12*a* of the cover portion 12 and the height ($H_2$) of the channel portion 14 of the lineal 10 may be varied according to differences in sizes or shapes of J-channels and desired aesthetic preferences. The length (L) of the lineal can be modified to conform to any length J-channel.

FIG. 3 is a sectional view of a frame trim assembly 60 shown securing a siding material 30. The frame trim assembly includes a J-channel 20 and a detachable lineal 10. As shown in FIG. 3, the latch portion 16 of the detachable lineal 10 is inserted into an opening 70 between the hook portion 22 of the J-channel and the siding material 30 until the latch portion 16 clears the terminal end of the hook portion 22, allowing the interlocking of the detachable lineal 10 and the J-channel 20. The channel portion 14 of the lineal 10 receives the hook portion 22 of the J-channel 20. The detachable lineal 10 is held securely in place between the hook portion 22 of the J-channel 20 and the siding material 30. If desired, the lineal 10 may be removed from the J-channel 20 by pulling the latch portion 16 of the lineal 10 through the opening 70 between the hook portion 22 of the J-channel 20 and the siding material 30. This allows the detachable lineal to be installed or uninstalled at will and allows for the exchanging of different lineals, for example, of different colors or designs, according to the preference of the building owner.

The frame trim assembly 60 runs for the entire length of each frame member 40 (See FIG. 4) surrounding an opening for a door or window. For a door frame, there would be three frame trim assemblies, two for the two vertical frame members and one for the horizontal frame member. For a typical window frame, there would be four frame trim assemblies, two for the two vertical frame members and two for the two horizontal frame members. One of ordinary skill in the art recognizes that the frame trim assembly of the present invention may be constructed to be used with any shaped opening to be framed.

FIG. 4 is a sectional view illustrating a finishing system comprising an exemplary embodiment of the frame trim assembly 60, a wall of a building 50, a frame surrounding an opening in the wall of a building 40, and a siding material 30. The J-channel 20 is mounted to the wall 50 by fasteners 90, such as nails or screws. The inner edge 28 of the J-channel 20 abuts against a door or window frame 40. A siding material 30 is received by the gap 24 of the J-channel. One of ordinary skill in the art recognizes that conventional steps of cutting the siding strips to length, installing the siding materials, and applying caulk are well understood and are not described herein.

Although the detachable lineal and corresponding frame trim assembly have been described herein as used in connection with door and window frames, the present invention is not limited thereto. For example, the detachable lineal and frame trim assembly may be used for inside and outside corners, drip caps, utility trim, fascia caps, sill covers and soffit systems. Further, although many exterior applications are apparent, the lineal may also be used for interior finishing.

Figure 5A:
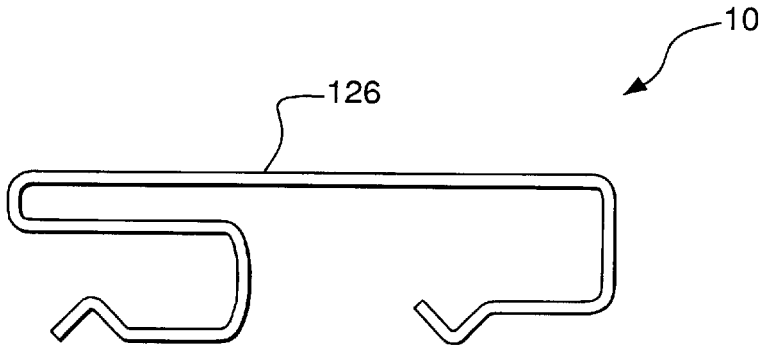
FIG. 5A is a sectional view of the lineal.
Figure 5B:
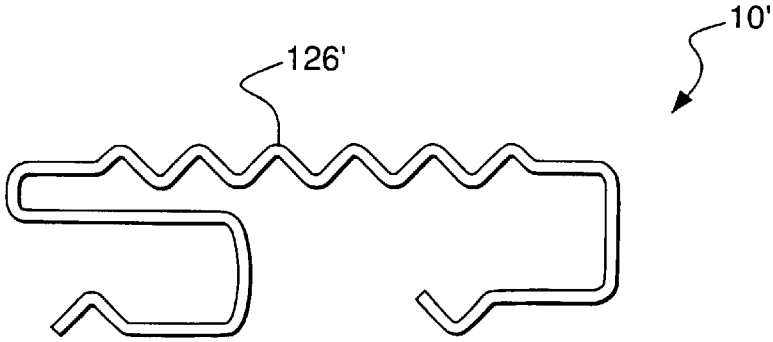
FIG. 5B is a sectional view of an alternative embodiment of the lineal.
Figure 5C:
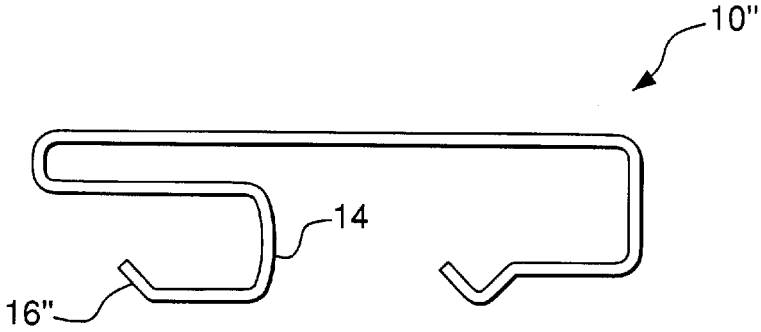
FIG. 5C is a sectional view of an alternative embodiment of the lineal.

FIGS. 5A–5C illustrate alternative embodiments of the detachable lineal. FIG. 5A illustrates the lineal 10 of FIG. 2, with a flat front face 12*b*. FIG. 5B illustrates a lineal 10' with a fluted front face 12*b*'. One of ordinary skill in the art recognizes that other front faces may be constructed having alternative decorative features. FIG. 5C illustrates an alternative lineal 10" having a latch portion 16" of the channel portion 14. One of ordinary skill in the art recognizes that other variations of latching mechanisms may be used without altering the interlocking function of the latch portion.

Although the invention has been described in terms of exemplary embodiments, it is not limited thereto. Rather, the appended claims should be construed broadly, to include other variants and embodiments of the invention which may be made by those skilled in the art without departing from the scope and range of equivalents of the invention.

What is claimed is:

1. An exchangeable lineal, comprising:

a cover portion having an inner edge and a front face; and a channel portion having a proximate member, a connecting member and a distal member, wherein the inner edge attaches the proximal member to the front face, and wherein the distal member includes a latch portion capable of detachably mounting the lineal from between a J-channel and a siding material, and wherein the latch portion comprises a raised section located proximate to a terminal end of said channel portion, and wherein the channel portion is capable of framing a hook portion of the J-channel, and wherein the front face of the cover portion extends beyond the connecting member of the channel portion.

2. The lineal of claim 1, wherein said front face is flat.

3. The lineal of claim 1, wherein said front face is fluted.

4. The lineal of claim 1, wherein said lineal is constructed of vinyl.

5. The lineal of claim 1, wherein said lineal is constructed of metal.

6. A finishing system, comprising:

a frame trim assembly, wherein the frame trim assembly comprises, a J-channel having a gap and a hook portion; and an exchangeable lineal comprising a cover portion having an inner edge, and a channel portion attached to the inner edge of the cover portion, wherein the channel portion includes a latch portion, wherein said latch portion comprises a raised section located proximate to a terminal end of said channel portion, and wherein said latch portion is capable of detachably mounting the lineal to and from the J-channel, and wherein the latch portion of the channel portion is insertable into the gap in the J-channel, and wherein the hook portion of the J-channel is framed by the channel portion of the lineal.

7. The finishing system of claim 6, further comprising a siding material, wherein the J-channel further comprises a mounting flange, and wherein the gap is between the hook portion and the mounting flange, and wherein the siding material is received by the gap of said J-channel, and wherein the latch portion of the lineal is inserted between the siding material and the hook portion of the J-channel.

8. The finishing system of claim 6, further comprising a wall of a building, a frame surrounding an opening in a building and a siding material, wherein the J-channel is mounted to the wall of the building and abuts the frame, and wherein the siding material is secured within the J-channel.

9. The finishing system of claim 8, wherein the J-channel includes a mounting flange and a gap between the mounting flange and the hook portion, and wherein the siding material is received within the gap of the J-channel, and wherein the latch portion of the lineal is inserted between the siding material and the hook portion of the J-channel.

10. A method for installing a finishing system comprising a J-channel and an exchangeable lineal, comprising the steps of:

mounting the J-channel having a hook portion to the wall of a building;

receiving one end of a siding material into the J-channel; and inserting the exchangeable lineal between said siding material and said J-channel, wherein said lineal comprises a cover portion having an inner edge and a channel portion having a latch portion which is capable of detachably mounting the lineal to said J-channel, and wherein said latch portion comprises a raised section located proximate to a terminal end of said channel portion, and wherein the channel portion of the lineal frames the hook portion of the J-channel.

11. The method the claim 10, wherein said J-channel comprises a hook portion, and the inserting step includes pressing the latch portion of the channel portion of the lineal between the siding material and the hook portion of the J-channel until the latch portion completely passes said hook.

12. The method of claim 11, wherein the inserting step further includes pressing the latch portion into a flattened position before the pressing step.

13. The method of claim 11, further comprising removing the lineal from the J-channel by pulling the latch portion of the channel portion of the lineal from between the hook of the J-channel and the siding material until the channel portion has completely cleared the J-channel.

14. The method of claim 10, further comprising abutting the J-channel against a frame surrounding an opening in a building.

* * * * *